US006149571A

United States Patent [19]

Okada et al.

[11] Patent Number: 6,149,571

[45] Date of Patent: Nov. 21, 2000

[54] CENTRIFUGE HAVING A ROTOR WITH CONVEX SURFACE MATCHING CONCAVE SURFACE OF NUT FOR SECURING ROTOR ON DRIVE SHAFT

[75] Inventors: Teruo Okada, Matsudo; Souichirou Matsushima, Oomiya; Masahiko Inagaki, Misato, all of Japan

[73] Assignee: Tomy Seiko Co., Ltd., Tokyo, Japan

[21] Appl. No.: 09/235,749

[22] Filed: Jan. 25, 1999

[51] Int. Cl.[7] ..... B04B 5/02; B04B 9/00

[52] U.S. Cl. ..... 494/20; 494/46; 494/82

[58] Field of Search ..... 494/16, 20, 46, 494/60, 82, 83, 84; 210/363–367; 384/193, 199, 203, 206

[56] References Cited

U.S. PATENT DOCUMENTS

| | | | |
|---|---|---|---|
| 292,705 | 1/1884 | Stevens . | |
| 330,345 | 11/1885 | Nielsen et al. . | |
| 579,301 | 3/1897 | Lundstrom . | |
| 699,003 | 4/1902 | Ohlsson . | |
| 1,361,283 | 12/1920 | Norris . | |
| 1,495,933 | 5/1924 | Swancara | 494/20 |
| 1,750,016 | 3/1930 | Meyer . | |
| 1,848,641 | 3/1932 | Meyer . | |
| 3,363,772 | 1/1968 | Jarvis . | |
| 3,770,191 | 11/1973 | Blum | 494/46 |
| 4,079,882 | 3/1978 | Mizuyoshi et al. | 494/20 |
| 4,099,667 | 7/1978 | Uchida | 494/20 |
| 4,193,536 | 3/1980 | Kubota | 494/20 |
| 5,358,342 | 10/1994 | Frisbee et al. | 384/206 |

FOREIGN PATENT DOCUMENTS

| | | | |
|---|---|---|---|
| 201320 | 9/1908 | Germany | 494/46 |
| 1128180 | 4/1962 | Germany | 494/20 |
| 15156 | 12/1902 | Sweden | 494/46 |

*Primary Examiner*—Charles E. Cooley
*Attorney, Agent, or Firm*—Varndell & Varndell, PLLC

[57] ABSTRACT

The centrifuge of the present invention is a centrifuge wherein a rotor is engaged integrally with a drive shaft, in the direction of turning, so that it can be freely attached and detached, wherein the drive shaft is attached to the equipment frame through elastic members, a spherical surface is formed in the upper part of the drive shaft, a spherical concave surface corresponding to the spherical surface in the drive shaft is formed in the top surface of a bearing hole in the rotor, the spherical concave surface of the bearing hole is made to ride on the spherical surface of the drive shaft, and the rotor is engaged so that it can swing freely relative to the drive shaft.

1 Claim, 4 Drawing Sheets

CENTRIFUGE HAVING A ROTOR WITH CONVEX SURFACE MATCHING CONCAVE SURFACE OF NUT FOR SECURING ROTOR ON DRIVE SHAFT

BACKGROUND OF THE INVENTION

1. Field of the Invention

This invention relates to a centrifuge, and particularly to a linking structure for engaging a rotor to the drive shaft of a motor, etc.

2. Description of the Related Art

In a centrifuge, as diagrammed in FIG. 4, a rotor 1 that is formed as an independent component is engaged with the drive shaft 3 of a motor 2.

In such a centrifuge as this, a linking structure is employed for engaging the rotor 1 with the drive shaft 3 wherein pins 4 are implanted in the drive shaft 3, grooves 6 are formed in the inner circumferential walls of a bearing hole 6 formed in the bottom surface of the rotor 1, and the pins 4 of the drive shaft 3 are inserted into these grooves 6, thereby linking the rotor 1 to the drive shaft 3.

Thus, in the centrifuge described here, the rotor 1 is in effect supported integrally by (the drive shaft 3 of) the motor 2, wherefore, in cases where the center of gravity of the rotor 1 does not coincide with the axis center of the drive shaft 3, there is a danger of the rotor 1 being turned eccentrically. In such cases as this, the rotor 1 manifests a gyro effect whereby it seeks to maintain a horizontal orientation, whereupon there is a danger that the rotor 1 will vibrate greatly, that the drive shaft 3 will be flexed, and that the durability of the drive shaft 3 will decline. When vibration in the rotor 1 becomes great, there is a danger that the rotor 1 will be seriously damaged.

What is done, in the face of this, is to reduce the flexure on the drive shaft 3 by absorbing the load of the drive shaft 3 described above by elastically supporting the motor 2 on the equipment frame so that the motor 2 is displaced. When such a configuration as this is adopted, however, in cases where the center of gravity of the rotor 1 does not coincide with the axis center of the drive shaft 3, as noted above, the amount of eccentricity that develops when the rotor 1 is turned becomes great.

In order to resolve such problems as this, in Japanese Utility Model Laid-open No. S48-57774/1973, art is disclosed wherein, in addition to elastically supporting the motor on the equipment frame, the rotor is elastically supported by the drive shaft.

In recent years, however, centrifuges have come into widespread use wherein buckets 7 are supported by the rotor 1 so that they can freely swing, as diagrammed in FIG. 4. In centrifuges such as this, it is very difficult to make the center of gravity of the rotor 1 coincide with the drive shaft 3. Not only so, but the mass of the rotor 1 is great. Because of this, it is not possible to safely prevent eccentric turning of the rotor 1 or flexure in the drive shaft 3.

SUMMARY OF THE INVENTION

Thereupon, an object of the present invention is to provide a centrifuge wherewith stable rotor turning can be realized and durability can be improved.

The centrifuge of the present invention is a centrifuge wherein: a rotor is integrally engaged with a drive shaft, so that it can freely be attached and detached, in the direction of turning; the drive shaft is secured to an equipment frame via elastic members; the upper part of the drive shaft is formed as a spherical surface; the top surface of a bearing hole in the rotor is formed as a concave spherical surface corresponding to the spherical surface of the drive shaft; the concave spherical surface of the bearing hole is mounted on the spherical surface of the drive shaft; and the rotor is engaged with the drive shaft so as to swing freely.

As based on the centrifuge of the present invention, because the rotor is mounted on the spherical surface of the drive shaft so that it can swing freely, and because the drive shaft is capable of displacement relative to the equipment frame, the rotor turns smoothly, without vibration, irrespective of the inclination between the position of the center of gravity of the rotor and the axis center of the drive shaft.

In the centrifuge of the present invention, moreover, a rotor is provided which has arms extending radially out from the center thereof, to the ends of which arms buckets are attached so that they can swing freely. The center of swing of the rotor is positioned within a plane containing the center of swing of the arms.

As based on this centrifuge, rotor balance is further enhanced.

DESCRIPTION OF THE REFERRED EMBODIMENTS

Figure 1:
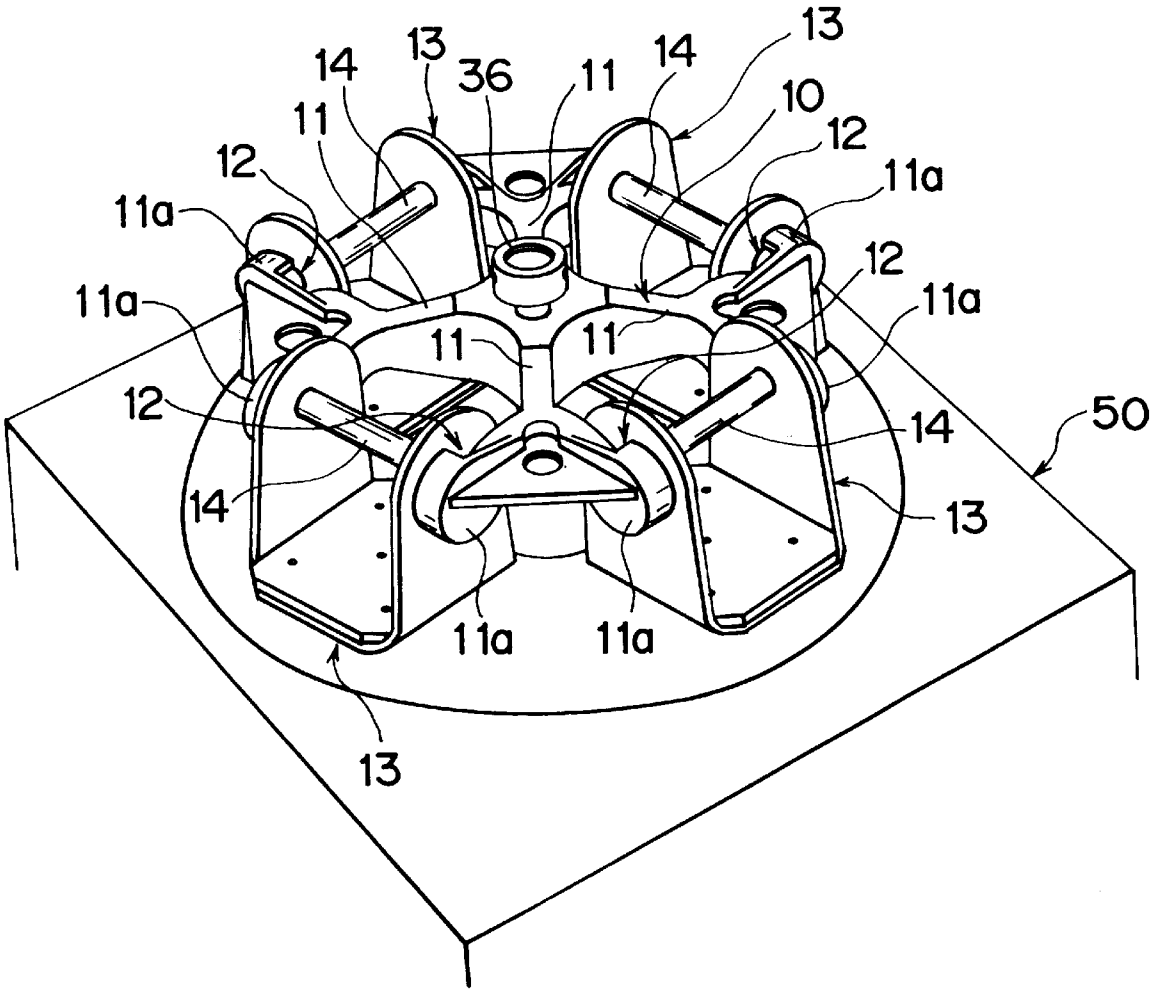
FIG. 1 is a diagonal view of a centrifuge according to the present invention.
Figure 2:
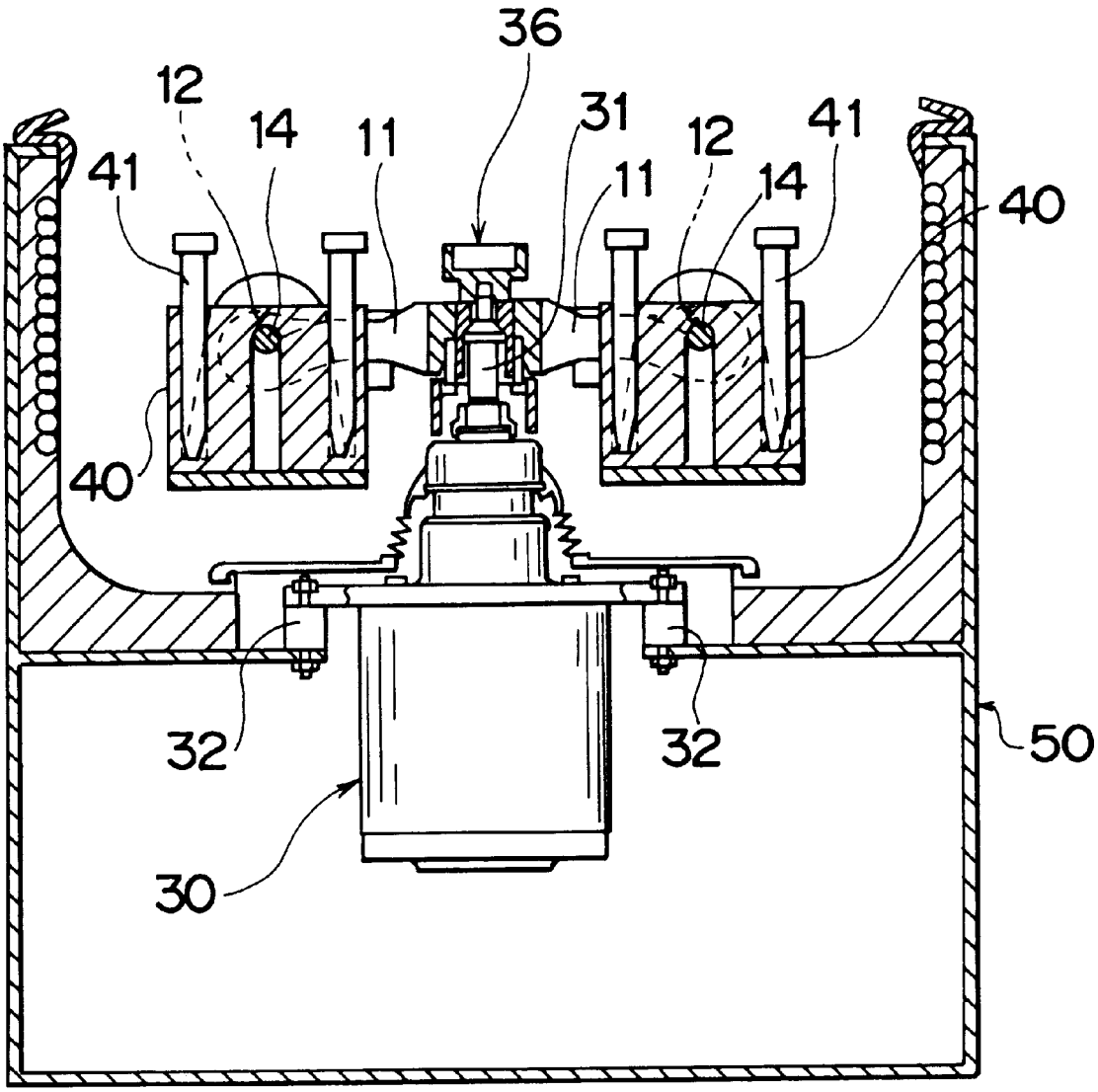
FIG. 2 is a cross-sectional diagram that represents the way a motor is installed, and the way that motor is linked to a rotor, in the centrifuge according to the present invention.
Figure 3:
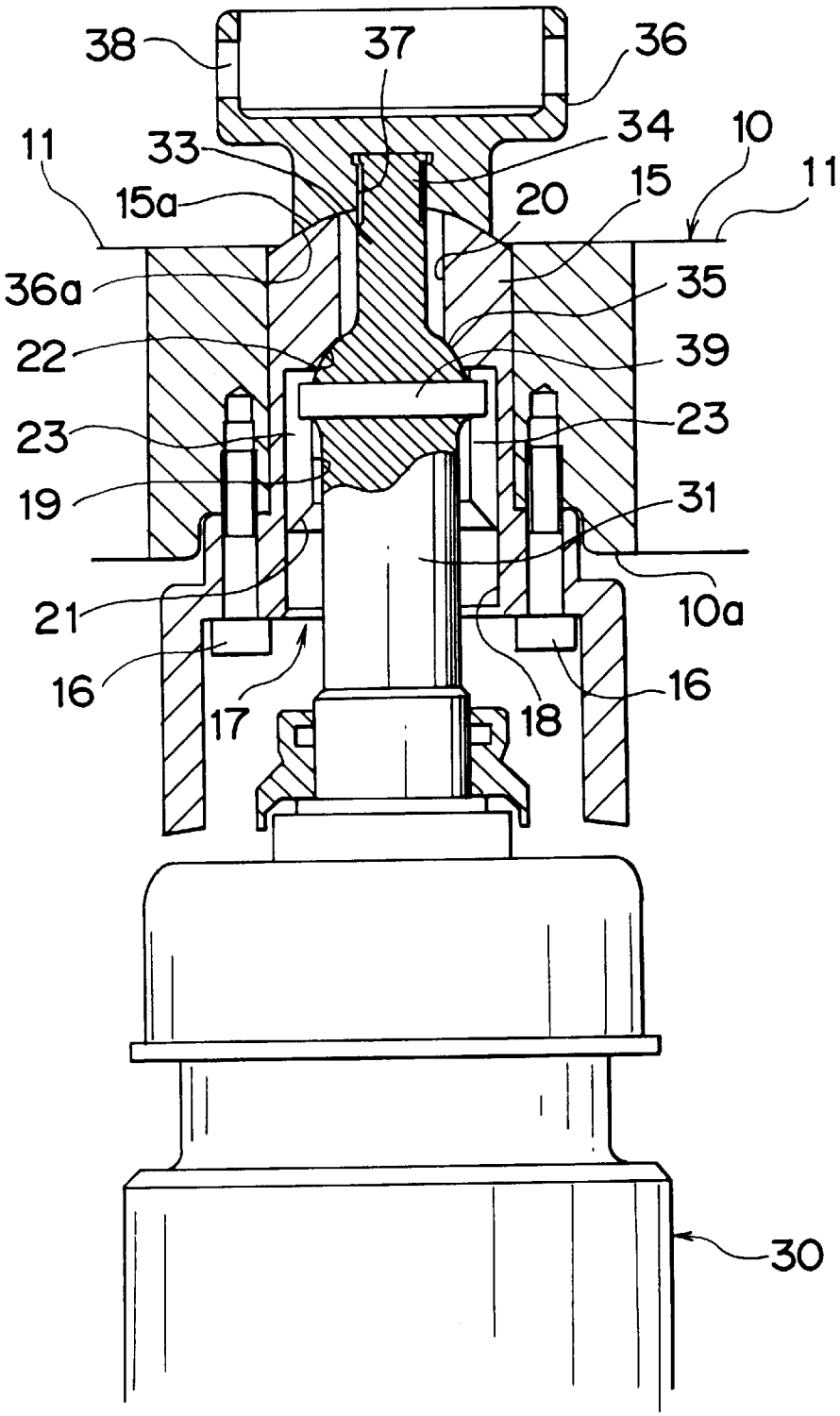
FIG. 3 is an enlarged cross-sectional diagram of a linking unit between a rotor and a drive shaft in the centrifuge according to the present invention.
Figure 4:
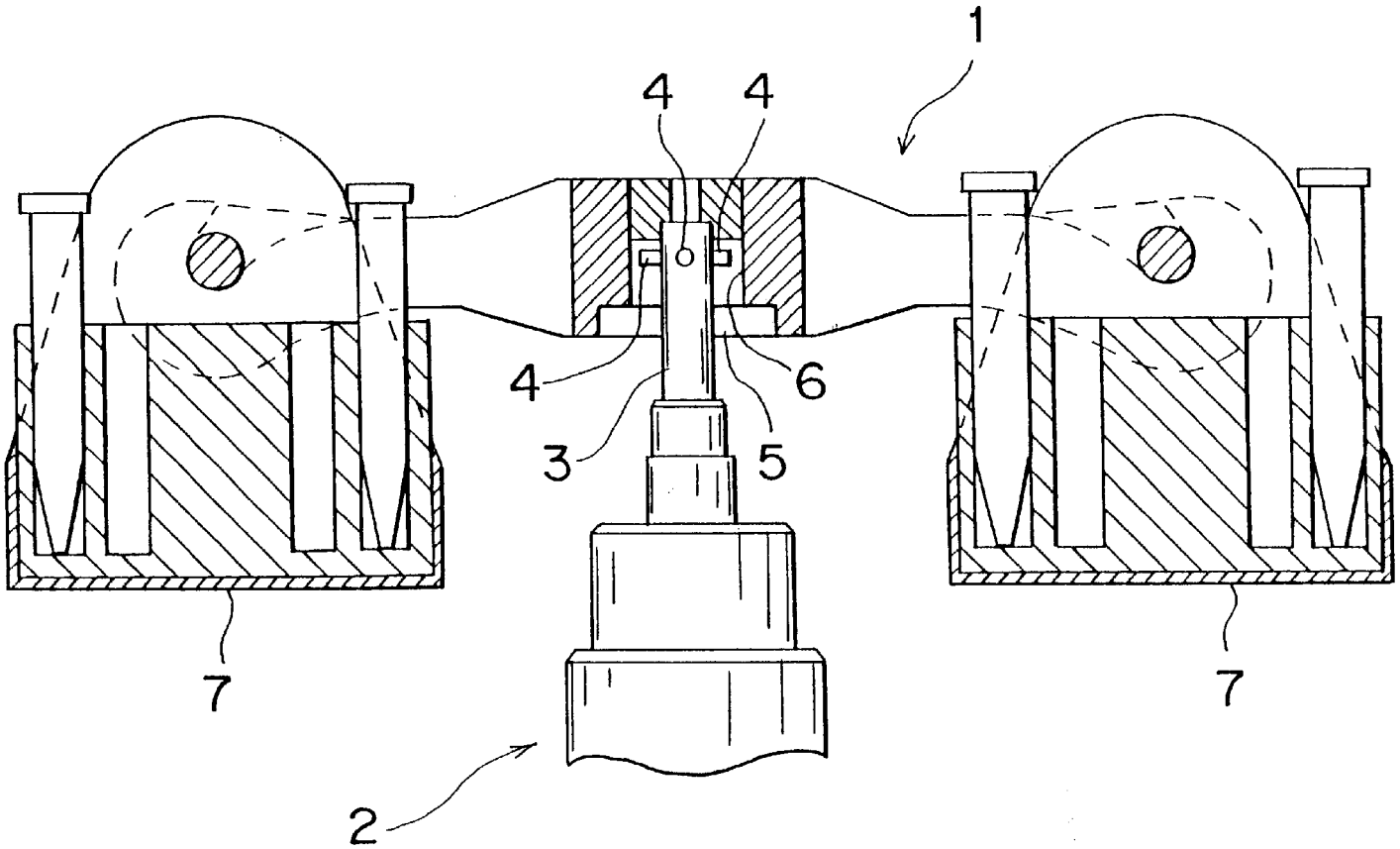
FIG. 4 PRIOR ART
FIG. 4 is a cross-sectional diagram of a linking structure between a rotor and a drive shaft in a conventional centrifuge.

FIGS. 1, 2, and 3 diagram a centrifuge according to the present invention. In this centrifuge, a rotor 10 is formed separately. This rotor 10 is mounted on a drive shaft 31 of a motor 30, as diagrammed in FIGS. 2 and 3.

As diagrammed in FIG. 1, the rotor 10 has four arms 11 that extend radially. In the ends of these arms 11 are formed brackets 11*a* and 11*a* that are separated so that they fork. In these brackets 11*a* and 11*a* are formed grooves 12 and 12 that are open upwards.

The rotor 10 also comprises buckets 13. These buckets 13 are formed in a ⊐ shape, to both side pieces of each of which are attached a shaft 14. Each of these shafts 14 extends to the outsides of the two side pieces. The ends of these extended parts are made to fit into the grooves 12 and 12 in the buckets 11*a* and 11*a*, whereupon the buckets 13 are supported by the arms 11 so that they swing freely.

Furthermore, as diagrammed in the enlarged view in FIG. 3, a block 15 made of a metal such as brass, for example, is securely attached by bolts 16 to the center of the bottom surface 10*a* of the rotor 10. In this block 15 is formed a bearing hole 17, open at the bottom. This bearing hole 17 has, from the bottom upwards, a large diameter part 18, a medium diameter part 19, and a small diameter part 20.

A tapered surface 21 is formed, inclining toward the inside of the bearing hole 17 from the large diameter part 18 to the medium diameter part 19, at the boundary part formed by the large diameter part 18 and the medium diameter part 19. A spherical concave surface 22 is formed, moreover, at the boundary part between the medium diameter part 19 and the small diameter part 29. Grooves 23 are formed, in the direction of the axis center, in the medium diameter part 19. And a spherical convex surface is formed in the upper end surface 15*a* of the block 15.

The motor 30, as diagrammed in FIG. 2, is secured to an equipment frame 50 via elastic members 32 made of rubber, etc. The drive shaft 31 of this motor 30 is formed of a metal such as stainless steel which is compatible, in terms of wear resistance, with the material of which the block 15 of the rotor 10 is made. This drive shaft 31 has a small diameter projecting part 33 in the end thereof, in which end are formed male threads 34. And a spherical concave surface 35 is formed in the base of the projection part 33 of this drive shaft 31, that is, in the shoulder portion at the boundary with the large diameter part.

The drive shaft 31 is also provided with a nut 36. In the lower surface 36*a* of this nut 36 is formed a spherical concave surface having roughly the same radius of curvature as the upper end surface 15*a* of the block 15, with female threads 37 formed in the middle of the lower surface thereof. In the upper part of this nut 33 is bored a hole 38 for inserting a control rod or the like for turning the nut 36 in a direction at right angles to the axis center of the female threads 37.

A pin 39 is imbedded in the lower part of the concave surface 35 in the upper part of the large diameter part of the drive shaft 31.

In a centrifuge configured in this way, when the bearing hole 17 of the rotor 10 is pushed down onto the drive shaft 31, the tapered surface 21 at the step comes up against the pin 39 in the drive shaft 31, whereupon, guided thereby, the axis center of the bearing hole 12 is matched with the axis center of the drive shaft 20.

Next, the inclined surface (not shown) of the step comes up against the pin 39, the drive shaft 31 is turned thereby, and the pin 39 is guided into the grooves 23 of the bearing, hole 17, whereupon the grooves 23 are mated with the pin 39, as diagrammed in FIG. 3.

In this condition, the configuration of the rotor 10 is such that the concave surface 22 in the block 15 thereof is riding on the convex surface 35 of the drive shaft 31. In addition, the female threads 37 of the nut 36 are screwed onto the male threads 34 in the end of the drive shaft 31. Thereupon, the nut 36 is tightened just enough so that the end of the male threads 34 come up against the nut 36, and so that the bottom surface 36*a* of the rut 36 lightly touches the upper end surface 15*a* of the block 15. In this condition, the rotor 10 is mounted on the drive shaft 31, with the center of swing thereof (the center of curvature of the convex surface 35 of the drive shaft 31) positioned within a plane that contains the axis centers of the shafts 14 of the buckets 13.

In the buckets 13 of the rotor 10 assembled in this manner, racks 40 are mounted, as diagrammed in FIG. 2, into which racks 40 are loaded tubes (test tubes) 41.

Now, when the drive shaft 31 of the motor 30 turns, the rotor 10 is turned through via pin 39 and grooves 23. When this happens, in cases where the axis center of the drive shaft 31 is slightly shifted away from the vertical and/or in cases where the center of gravity of the rotor 10 is slightly shifted away from the axis center of the drive shaft 31, the spherical convex surface 22 of the rotor 10, due to the gyro effect of the rotor 10, is displaced, sliding on the convex surface 35 of the drive shaft 31, so as to maintain a horizontal condition. At the same time, a force develops which pushes the drive shaft 31 toward the vertical. Thus the attitude of the drive shaft 31 is guaranteed together with that of the motor 30. Accordingly, vibration in the rotor 10 is suppressed.

As described in the foregoing, with the centrifuge of the present invention, the rotor is held at the drive shaft so that it can swing freely, and the motor is attached to the equipment frame through elastic members, wherefore, even though the axis center of the drive shaft diverges from the vertical, or the rotor center of gravity shifts away from the axis center of the drive shaft, the turning motion of the rotor is regulated so that the rotor is effectively damped.

As based on the centrifuge in this present invention, moreover, the unit for linking the rotor and the drive shaft can be formed of a metal or other rigid material, wherefore the invention can be applied also to rotors of large mass, and durability can be enhanced.

What is claimed is:

1. A centrifuge comprising:

a motor secured to an equipment frame by elastic members, said motor having a drive shaft, an upper part of said drive shaft having a convex surface;

a rotor having a bearing hole receiving said drive shaft, said bearing hole including a concave surface matching said convex surface of said upper part of said drive shaft; said rotor freely attaching and detaching from said drive shaft in a direction of turning so that said rotor engages said drive shaft with said concave surface of said bearing hole of said rotor resting on said convex surface of said upper part or said drive shaft;

said rotor including a center, arms extending radially outward from said center, buckets attached to said arms by shafts so that the buckets can swing freely, wherein an axis of said shafts is positioned in a plane containing a center of curvature of said convex surface of said drive shaft, whereby a center of swing of said rotor is positioned within said plane containing a center of swing of said arms, said drive shaft having a top with threads, said rotor is secured to said drive shaft by a nut threaded on said threads of said drive shaft, said nut having a bottom with a concave surface, said rotor having a convex surface matching said concave surface of said nut, and said nut is tightened on said drive shaft until said concave surface of said nut rests on said convex surface of said rotor.

* * * * *